United States Patent [19]

Eriksson

[11] Patent Number: 4,861,374

[45] Date of Patent: Aug. 29, 1989

[54] NON-ABRASIVE POLISH OR CLEANING COMPOSITION AND PROCESS FOR ITS PREPARATION

[76] Inventor: Jan-Olof Eriksson, Midsommarstigen 23, S-391 52 Skelleftea, Sweden

[21] Appl. No.: 114,834

[22] Filed: Oct. 30, 1987

[30] Foreign Application Priority Data

Oct. 30, 1986 [EP] European Pat. Off. ..... 86850380

[51] Int. Cl.[4] ..... C09G 1/04; C11D 7/08

[52] U.S. Cl. ..... 106/3; 252/101; 252/102; 252/142; 252/149; 252/541

[58] Field of Search ..... 106/3; 252/101, 102, 252/142, 149, 541

[56] References Cited

U.S. PATENT DOCUMENTS

| | | | |
|---|---|---|---|
| 3,196,113 | 6/1965 | Ponchel | 252/101 |
| 3,228,816 | 1/1966 | Kendall | 204/129.95 |
| 3,293,093 | 12/1966 | Jones | 204/106 |
| 3,407,141 | 10/1968 | Banush et al. | 252/99 |
| 3,463,733 | 8/1969 | Acherbach | 252/148 |
| 3,468,804 | 9/1969 | Perry | 106/14.13 |
| 3,668,131 | 6/1972 | Banush et al. | 252/148 |
| 4,397,753 | 8/1983 | Czaja | 252/142 |

FOREIGN PATENT DOCUMENTS

| | | |
|---|---|---|
| 1919820 | 6/1970 | Fed. Rep. of Germany . |
| WO303252 | 9/1983 | World Int. Prop. O. . |

OTHER PUBLICATIONS

Chemical Abstracts vol. 90, No. 24, 11, Jun. 1979, p. 518, Abstract No. 194581s.

Chemical Abstracts, vol. 83, No. 2, 14, Jul. 1975, p. 287, Abstract No. 14801n.

*Primary Examiner*—Paul Lieberman

*Assistant Examiner*—Helene Kirschner

*Attorney, Agent, or Firm*—Fred Philpitt

[57] ABSTRACT

A non-abrasive polish or cleaning composition is disclosed, which comprises an aqueous solution having a pH-value within the range of −1 to 0 and containing 0.01–10% by weight of a substance obtained by (a) oxidizing an aqueous solution comprising 0.01–10% by weight of thiourea having a pH-value of 0–1, preferably 0.1–0.5, by means of a potent oxidizing agent or by electrolysis of the solution to the formation of a disulphide derivative of thiourea and (b) subsequent heating of the solution to the boiling point thereof for at least two hours.

The invention also comprises a process for the preparation of the composition according to the invention, which process comprises preparing an acid aqueous solution containing 0.01–10% by weight of thiourea and having a pH-value within the range of 0–1, preferably 0.1–0.5, oxidizing substantially the whole amount of thiourea in the way set forth in (a) above, heating the solution in the way set for the in (b) above and adjusting, when necessary, the pH of the solution to a value within the range of −1 to 0.

8 Claims, No Drawings

NON-ABRASIVE POLISH OR CLEANING COMPOSITION AND PROCESS FOR ITS PREPARATION

The present invention relates to a non-abrasive polish or cleaning composition for polishing or cleaning surfaces of copper, nickel, zinc, tin, lead or a noble metal, such as silver, gold or platinum or of an alloy substantially comprising at least one of said metals. The invention also relates to a process for the preparation of said composition.

High-conductive metals are utilized within the electronic industry in order to eliminate to the highest possible extent electric losses by different forms of electric resistance. Such undesired resistance can, for instance, appear as a contact resistance between two or more surfaces in electrical contact with each other. Very great demands are often made upon such metal surfaces and such surfaces are often and to an ever increasing extent made in extremely expensive materials in order to facilitate electric contact to the highest extent possible without any loss of energy and to attain the best possible reliability in operation. Such contact surfaces can be produced by coating or plating with an extremely thin layer of the expensive material. It appears that within, for instance, electric industry today silver-coated surfaces are often used in electric equipment and components in order to promote electric contact. Within the electronic sector surface coatings of silver, gold as well as of other noble metals are occuring on various components where an extremely good electric contact is a prerequisite. The use of highly pure copper for electronic purposes also occurs, for instance, copper produced as single crystal.

In the use of electric equipment containing such high conductive surfaces it is, of course, of the greatest importance that the desired high conductivity is retained also in and at the contact surfaces. In spite of the selection of expensive metals, in many cases exceptionally expensive and of advanced quality as indicated above, in order to achieve the desired low contact resistance, however, it has become apparent that the intended favourable effect is radically and often suddenly impaired during use. The moment at which this impairment arises depends on many factors, i.e. the surrounding atmosphere, but local operation conditions are probably of particular importance. Such local influence upon the contact surface layers in electric equipment can, for instance, arise from overheating, spark formation, local formation of corrosive gases, such as ozone, and the like.

In electric industry such components or apparatus parts containing contact surfaces of metal are practically always exchanged and scrapped when a reduced contact ability has been established.

In the electric sector, at least as far as gold—and noble metal-coated surfaces are concerned, a degreasing agent, for instance isopropanol, is used in order to reduce as far as possible the negative effects in case of increased contact resistance. However, this only helps momentarily and to a limited extent since, in principle, only contact obstructing grease layers or films are dissolved thereby. In case of silver-coated surfaces there is today normally no alternative to discarding of coated parts.

Pickling with acid solutions is frequently used in order to remove layers of surface contaminations from metal surfaces or reduce such layers, for instance in metal working industry. However, up to the present no suitable diluted acid has been found that can be used to meet the advanced demands raised by the electric and electronic industry for these specific application fields. Thus it has not been possible to satisfy the requirements raised in this connection, especially with reference to rapid effect upon the contact reducing layer or film resulting in the absence of contact reducing residues on the surface after the treatment without any substantial dissolution of metal.

A non-abrasive polish or cleaning composition for cleaning and polishing of household objects of copper, silver or chromium or alloys of these metals is disclosed in EP-A- 0 102 986. This composition comprises an aqueous solution containing 5–10% by weight of thiourea and 1–3% by weight of nitric acid (calculated as 100% $HNO_3$).

There is no teaching about the use of this prior art composition for removing contact reducing films or layers from surface coatings of silver, gold and other noble metals in the electric or electronic industry. Moreover, thiourea is recognized as a carcinogenic substance, the application of which in compositions for public use is restricted for that reason.

Accordingly it is an object of the present invention to provide a non-abrasive polish or cleaning composition which is generally applicable for cleaning or polishing surfaces of copper, nickel, zinc, tin, lead or a noble metal, such as silver, gold or platinum or of an alloy substantially comprising at least one of said metals, including contact surfaces of said metals or alloys occuring in electric or electronic industry, which composition exerts a rapid effect upon the contact reducing layer or film with no substantial dissolution of metal and no contact reducing residues on the surface after the treatment.

It is another object of the present invention to provide a non-abrasive polish or cleaning composition which is less hazardous from medical point of view in comparison with the prior art composition mentioned above.

It is a further object of the present invention to provide a method for the preparation of a non-abrasive polish or cleaning composition having the above mentioned application field and properties.

The composition according to the invention is characterized in that it comprises an aqueous solution having a pH-value within the range of −1 to 0 and containing 0.01–10% by weight of a substance obtained by a) oxidizing an aqueous solution comprising 0.01–10% by weight of thiourea having a pH-value of 0–1, preferably 0.1–0.5 by means of a potent oxidizing agent, such as nitrous acid, nitric acid or hydrogen peroxide, or by electrolysis of the solution to the formation of a disulphide derivative of thiourea and b) subsequent heating of the solution to the boiling point thereof for at least two hours.

The composition according to the invention preferably contains nitric acid as the acid utilized to control the pH-value. A suitable concentration of nitric acid will generally be in the range of 4–9% by weight (the nitric acid being calculated as 100% $HNO_3$)

A polish or cleaning composition according to the invention which is particularly intended for polishing or cleaning surfaces of copper or alloys based on copper preferably contains 0.01–0.10% by weight of the substance obtained by treating thiourea in the above described manner. The above amount should be both suitable and sufficient.

In case of surfaces coated with or consisting of silver, gold or other noble metals or alloys substantially based on at least one of said metals it was found suitable to use a composition containing 8.5–9.5% by weight of the substance obtained by treating thiourea in the above described manner.

The composition according to the present invention affords the following advantages when applied to contact surfaces in electric or electronic industry.

1. The composition acts rapidly.
2. The time of exposure is not critical and can be selected substantially as required without risk of attack on the metal.
3. The composition can easily be applied for action on contact surfaces in an apparatus already installed.
4. No residual products are formed, which is extremely important in this connection and probably is the explanation to why hitherto no other composition has been considered suitable for this use.
5. The composition can be applied to copper surfaces as well as to surfaces of noble metals and also to surfaces coated with extremely thin layers of extremely expensive metals or advanced metal qualities because there should be no risk of abrasion or dissolution of the metal itself.

The composition according to the invention may also contain additives, such as wetting agents in order to facilitate the rinsing away of the composition after the treatment.

For applications in the electric or electronic industry the composition according to the invention is preferably applied to the metal surface to be treated by means of a brush or similar means whereafter the composition is allowed to work for a short while and then the surface is rinsed with lukewarm water and dried. If desired, after rinsing with water, the surface is further rinsed with an aqueous solution of a detergent and then again with water before drying.

When using the composition according to the invention for polishing household objects, the composition is preferably applied to the surface to be polished with a wad of cotton wool and then left to work until the required shine is obtained, whereafter the object is rinsed with luke-warm water (and possibly with an aqueous solution of a detergent and again with water) and is then dried.

The process according to the invention is characterized in (a) preparing an acid aqueous solution containing 0.01–10% by weight of thiourea and having a pH-value within the range of 0–1, preferably 0.1–0.5,
(b) oxidating substantially the whole amount of thiourea by means of a potent oxidizing agent, such as nitrous acid, nitric acid or hydrogen peroxide, or by electrolysis of the solution to the formation of a disulphide derivative of thiourea,
(c) subsequently heating the solution to the boiling point thereof for at least two hours and
(d) adjusting, when necessary, the pH of the solution to a value within the range of −1 to 0.

The structure of the product obtained when treating thiourea in accordance with the process according to the present invention has not been clarified as yet.

In step (b) of the process of the present invention an oxidizing agent is chosen which is soluble in water and does not result in the formation of by-products which are insoluble in the product solution or which are undesirable in the product solution from other points of view.

Step (c) is carried out using a reflux condenser. The solution is preferably heated to continuous vigorous boiling.

The preferred acid used for adjusting pH in steps (a) and b) is nitric acid.

The invention will now be illustrated further by means of a number of non-limitative working examples

EXAMPLE 1

90 g of thiourea were dissolved in 1000 ml of water having a temperature of 50°–60° C. Then 100 ml nitric acid (53% by weight of $HNO_3$) were added and the mixture was stirred for 3 minutes whereafter 100 ml of an aqueous solution of hydrogen peroxide (30% by weight of $H_2O_2$) were added. The mixture was left for 2 hours and was then heated to the boiling temperature. Continuous vigorous boiling under reflux was carried out for 2 hours whereafter the mixture was allowed to cool to about 50 C. Then 100 nitric acid (53 % by weight of $HNO_3$) were added while stirring to give a solution having a pH-value of about −0.5.

The product thus obtained can be used as a polish or cleaning composition for surfaces of copper, nickel, zinc, tin, lead or a noble metal, such as silver, gold or platinum, or of an alloy substantially comprising at least one of said metals.

EXAMPLE 2

The procedure of Example 1 was repeated but the amounts of thiourea and hydrogen peroxide solution used were 45 g and 50 ml, respectively.

The product thus obtained can be used as a polish or cleaning composition for surfaces of copper or of an alloy substantially comprising copper.

EXAMPLE 3

90 g of thiourea were dissolved in 1000 ml of water having a temperature of 50–60°C. Then 200 ml nitric acid (53% by weight of $HNO_3$) were added and the mixture was stirred for 3 minutes whereafter it was heated to the boiling temperature. Continuous vigorous boiling under reflux was carried out for about 17 hours whereafter the mixture was allowed to cool to about 50°C. Then 100 ml nitric acid (53% by weight of $HNO_3$) were added while stirring to give a solution having a pH-value of about −0.5.

The product thus obtained can be used as a polish or cleaning composition for surfaces of copper, nickel, zinc, tin, lead or a noble metal, such as silver, gold or platinum, or of an alloy substantially comprising at least one of said metals.

I claim:

1. A non-abrasive composition for polishing or cleaning surfaces of copper, nickel, zinc, tin, lead, a noble metal, or an alloy substantially comprising at least one of said metals, which composition comprises an aqueous solution having a pH-value within the range of −1 to 0 and containing 0.01–10% by weight of a substance obtained by (a) oxidizing an aqueous solution comprising 0.01–10% by weight of thiourea having a pH-value of 0–1 by means of 4–9% by weight potent oxidizing agent, or by electrolysis of the solution to thereby form a disulphide derivative of thiourea, (b) subsequently heating the solution to the boiling point thereof for at least two hours.

2. A composition according to claim 1 which contains nitric acid.

3. A composition according to claim 2 wherein the content of nitric acid is 4–9% by weight, calculated as 100% $HNO_3$.

4. A composition according to claim 1 that is particularly useful for polishing or cleaning surfaces of copper or alloys based on copper, wherein said aqueous solution contains 0.01–0.10% by weight of said substance.

5. A composition according to claim 1 that is particularly intended for polishing or cleaning surfaces of noble metals or of an alloy containing a noble metal wherein said aqueous solution contains 8.5–9.5% by weight of said substance.

6. A composition according to claim 1 wherein in step (a) the pH is 0.1–0.5.

7. Process for the preparation of the composition set forth in claim 1 which comprises (a) preparing an acid aqueous solution containing 0.01–10% by weight of thiourea and having a pH-value within the range of 0–1, (b) oxidizing substantially the whole amount of thiourea (1) by means of a potent oxidizing agent selected from the group consisting of nitrous acid, nitric acid and hydrogen peroxide or (2) by electrolysis of the solution to thereby form a disulphide derivative of thiourea, (c) subsequently heating the solution to the boiling point thereof for at least two hours, and (d) maintaining the pH of the solution to a value within the range of −1 to 0.

8. The process of claim 7 wherein in step (a) the pH is 0.1–0.5.

* * * * *